US010882099B2

(12) United States Patent
Chen

(10) Patent No.: US 10,882,099 B2
(45) Date of Patent: Jan. 5, 2021

(54) TOOL MANUFACTURING METHOD AND TOOLS PRODUCED THEREBY

(71) Applicant: FLOZFIRM TECHNOLOGY RESEARCH CO., LTD., Tainan (TW)

(72) Inventor: Pei-Hua Chen, Tainan (TW)

(73) Assignee: Flozfirm Technology Research Co., Ltd., Tainan (TW)

( * ) Notice: Subject to any disclaimer, the term of this patent is extended or adjusted under 35 U.S.C. 154(b) by 0 days.

(21) Appl. No.: 16/518,284

(22) Filed: Jul. 22, 2019

(65) Prior Publication Data

US 2020/0078854 A1 Mar. 12, 2020

(30) Foreign Application Priority Data

Sep. 6, 2018 (TW) ..... 107131298 A

(51) Int. Cl.
*B21K 5/16* (2006.01)
*B21J 5/12* (2006.01)

(52) U.S. Cl.
CPC .. *B21K 5/16* (2013.01); *B21J 5/12* (2013.01)

(58) Field of Classification Search
CPC ..... B21K 5/16; B21H 5/027; B21J 5/12
USPC ..... 76/101.1, 114, 119
See application file for complete search history.

(56) References Cited

U.S. PATENT DOCUMENTS 3,103,833 A * 9/1963 Lejdegard ..... B21K 5/00 76/1
5,619,882 A * 4/1997 Godtner ..... B21J 5/12 72/351
5,868,047 A * 2/1999 Faust ..... B23P 15/00 81/438
8,281,693 B2 * 10/2012 Shih ..... B25B 15/008 29/557
8,800,407 B2 * 8/2014 DeBaker ..... B25B 15/002 76/108.1
9,067,307 B2 * 6/2015 Kozak ..... B25B 15/005
2013/0091991 A1 * 4/2013 Lee ..... B21K 5/00 76/119
2018/0117664 A1 * 5/2018 Taniguchi ..... B21H 3/06
2020/0078854 A1 * 3/2020 Chen ..... B21H 5/027

FOREIGN PATENT DOCUMENTS

| | | |
|---|---|---|
| TW | 453917 | 9/2001 |
| TW | 201309431 A1 | 3/2013 |
| TW | I404601 B1 | 8/2013 |
| TW | I486236 B | 6/2015 |
| TW | 201643007 A | 12/2016 |

* cited by examiner

*Primary Examiner* — Hwei-Siu C Payer
(74) *Attorney, Agent, or Firm* — Rosenberg, Klein & Lee

(57) ABSTRACT

A tool manufacturing method includes the steps of preparing a cylindrical blank, dividing the blank into sections, changing an outer diameter of one of the sections, and shaping the sections to complete a tool. During the shaping step, the section whose outer diameter is changed is shaped into a symmetrical polygon for serving as a head portion of the tool and shaping another section to obtain a polygon with alternate concavities and convexities thereon for serving as an engaging portion of the tool. Accordingly, the progressive execution of the method prevents the deterioration of the blank made of a high carbon content metal material, allows the tool to keep good mechanical properties, increases the manufacturing efficiency, and reduces manufacturing costs.

13 Claims, 15 Drawing Sheets

TOOL MANUFACTURING METHOD AND TOOLS PRODUCED THEREBY

BACKGROUND OF THIS INVENTION

1. Field of this Invention

This invention relates to a manufacturing method and relates particularly to a method of manufacturing a tool and tools made by the method.

2. Description of the Related Art

Generally, tools are used to cooperate with self-drilling and self-tapping screws and are high-torque instruments capable of delivering full driving forces to rotate screw heads when they are held by a driving mechanism or held in hands of users. The tool is mainly made of alloys and high carbon content steel materials. A cracking problem is easily incurred because of the high carbon content while processing the material by presses or forging presses. This condition also causes some defects, such as deformation, breakage, displacements of crystal grains, and the generation of cavities. Even though a blank is shaped into the tool and then the tool is treated by tempering, the finished tool is still a defective product.

To produce a tool, materials are subjected to requisite treatments by turning and milling tool machines. In FIG. 1, a conventional method includes the steps of:

(A) Preparing a cylindrical rolled wire rod;

(B) Treating said wire rod by a skin-pass drawing to obtain a hexagonal wire rod;

(C) Obtaining a hexagonal blank by cutting from a length of the hexagonal wire rod;

(D) Treating two ends of the hexagonal blank by turning, a machining process, and then chamfering;

(E) Turning a portion of the hexagonal blank adjacent to one of the ends to form an annular groove;

(F) Turning the other end of the hexagonal rod to form a shank; and (G) Milling a distal end of the shank to form a tool head, thereby completing a tool.

The conventional method is, however, not economical because of more processing time and lots of waste, so it still needs improvements.

SUMMARY OF THIS INVENTION

An object of this invention is to provide a method for processing the high carbon content material by forging, thereby increasing the tool manufacturing efficiency and reducing costs of manufacturing the tool.

The method of this invention adapted to make a tool having a head portion formed in a symmetrical polygon and an engaging portion formed opposite to or connected to the head portion and having a polygon contour with an alternation of concavities and convexities thereon. An outer diameter of the engaging portion is smaller than an outer diameter of the head portion. The method includes the steps of preparing a cylindrical blank, processing the blank so that blank can be divided into a first section and a second section, changing an outer diameter of the first section, and then shaping the first section into a symmetrical polygon for serving as the head portion of the tool and also shaping the second section to have a polygonal contour with alternate concavities and convexities thereon. The shaped second section serves as the engaging portion of the tool. Preferably, the method also forms a positioning annular groove annularly on the first section. Accordingly, execution steps of the method are executed in sequence to prevent the degradation or deterioration of properties of the blank made of high carbon content metal, so the tool keeps good mechanical properties. The progressive execution also increases the efficiency of making tools and decreases manufacturing costs.

Preferably, the tool made by the method can further include at least one shank portion disposed between the head portion and the engaging portion. To make the three-tiered or multiple-tiered tool, the section-subdividing step of the method is executed to form at least one third section between the first section and the second section, with the first section, the second section and the third section having respective outer diameters which are different from each other, as for example shown in the preferred embodiments that the outer diameter of the third section can be larger than the outer diameter of the second section but is smaller than the outer diameter of the first section. Accordingly, the third section serves as the shank portion of the tool after the shaping step is completed.

Preferably, the preparatory shaping operation is executed by pressing one end of the first section with a stamping die to thereby enlarge the outer diameter of the first section.

Preferably, the shape processing operation is executed by using pressing dies to add compressive forces to the first section so that the first section is shaped into the symmetrical polygon. The shape processing operation is also executed to press the second section by rolling between first rolling dies so that the second section is shaped to form the polygon having alternate concavities and convexities thereon.

Preferably, in the shape processing operation, the first section is pressed annularly to form a positioning annular groove on a peripheral surface of the first section. It is also possible that the portion or portions between the positioning annular groove and the polygonal arrangement of the second section can be annularly pressed to form at least one auxiliary annular groove thereon. The positioning annular groove and the auxiliary annular groove or grooves can be annularly formed by at least a pair of second rolling dies. Accordingly, the positioning annular groove and the auxiliary annular groove or grooves are concurrently formed or are not concurrently formed.

The advantages of this invention are more apparent upon reading following descriptions in conjunction with drawings.

BRIEF DESCRIPTION OF THE DRAWINGS

FIG. 5-1 is a schematic view showing execution steps of the first preferred embodiment of this invention;

FIG. 5-2 is a schematic view showing a variation of the first preferred embodiment of this invention;

FIGS. 5-3 to 5-7 are partial schematic views showing variations applied to the shape processing operation of the first preferred embodiment of this invention;

FIG. 6 is a schematic view showing pressing dies applied to the shape processing operation of the shaping step of this invention;

FIG. 7 is a schematic view showing first rolling dies applied to the first preferred embodiment of this invention;

DETAILED DESCRIPTION OF THE PREFERRED EMBODIMENTS

Figure 2:
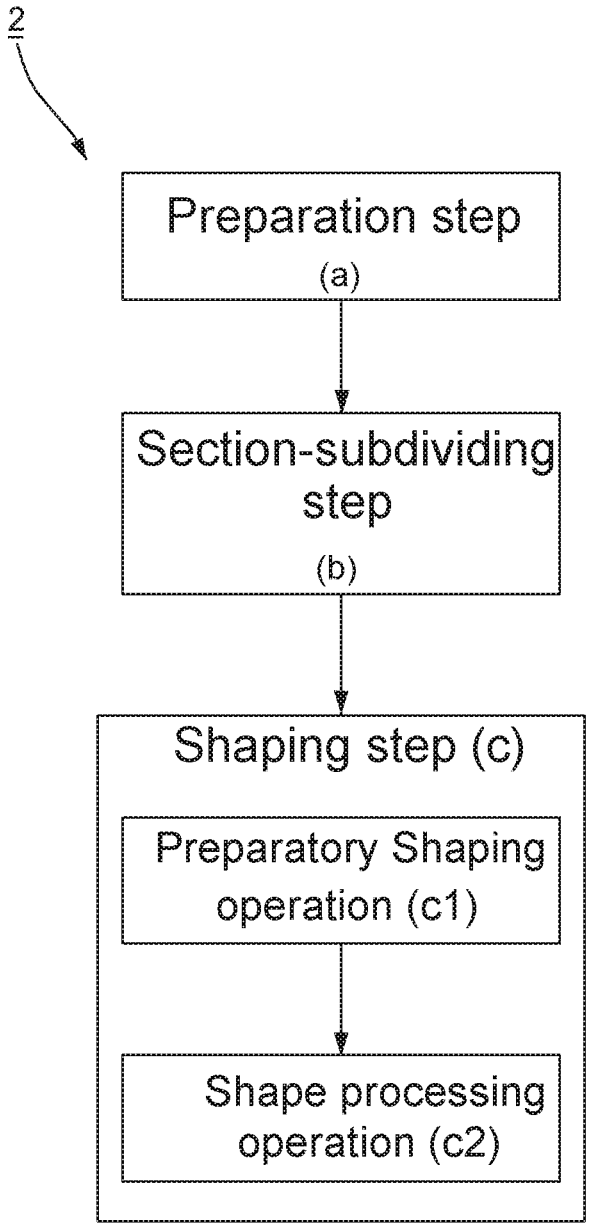
FIG. 2 is a block diagram showing execution steps of a method of this invention for making a tool in sequential order.
Figure 3:
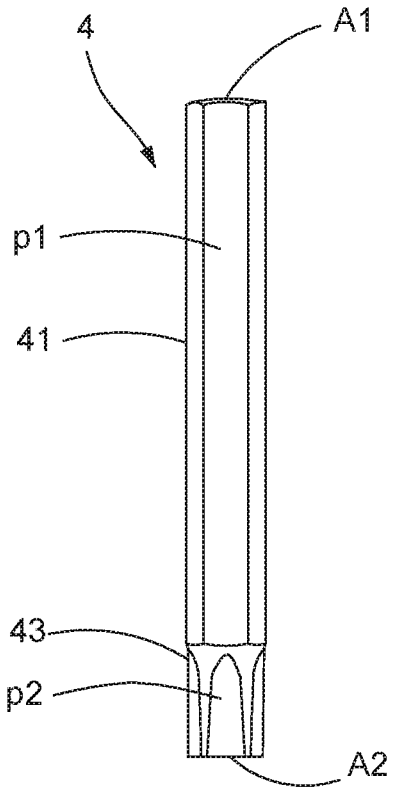
FIGS. 3 and 4 are schematic views of tools to be made of a first preferred embodiment of this invention.
Figure 4:
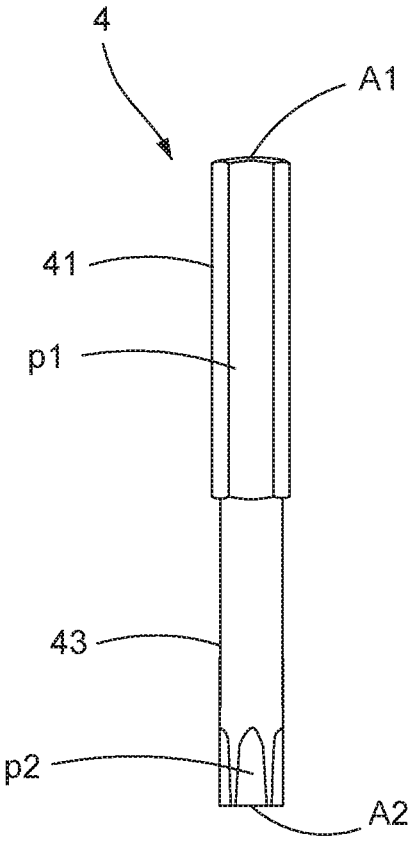

Referring to FIG. 2, a tool manufacturing method 2 of this invention includes a preparation step (a), a section-subdividing step (b), and a shaping step (c). In a first preferred embodiment of this invention, the method 2 is executed to make a tool 4 mainly including a first end A1, a second end A2 opposite to the first end A1, a head portion 41, and an engaging portion 43, shown in FIGS. 3 and 4. Specifically, the head portion 41 extends from the first end A1 and is in the shape of a symmetrical polygon p1. The engaging portion 43 is disposed between the head portion 41 and the second end A2. In this preferred embodiment, the engaging portion 43 extends from the head portion 41 to the second end A2 and has the shape of a polygon p2 having alternate concavities and convexities formed thereon.

Figure 1:
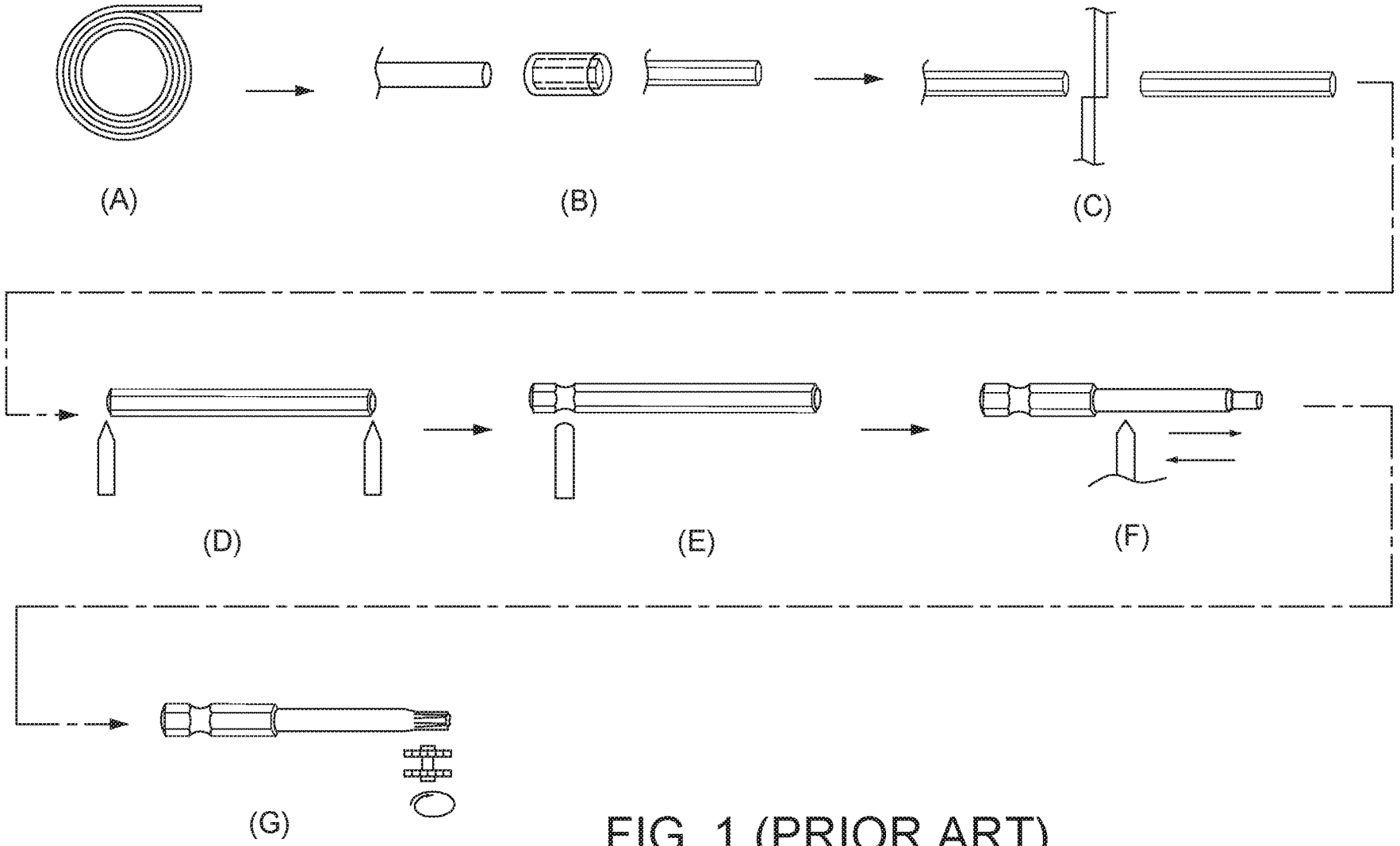
FIG. 1 (PRIOR ART)
FIG. 1 is a schematic view showing a conventional method for making a tool.
Figures 1, 5:
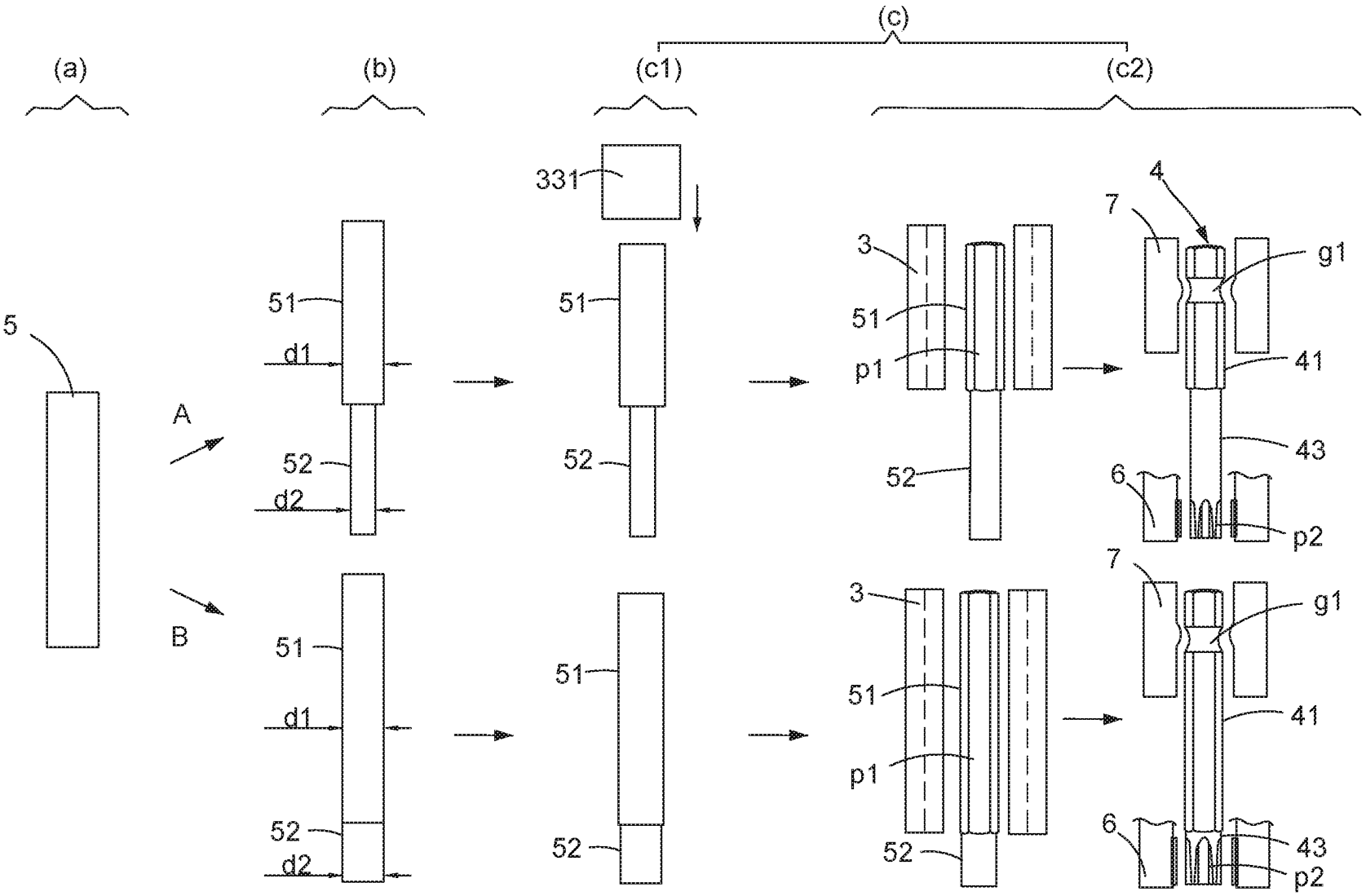
Figures 2, 5:
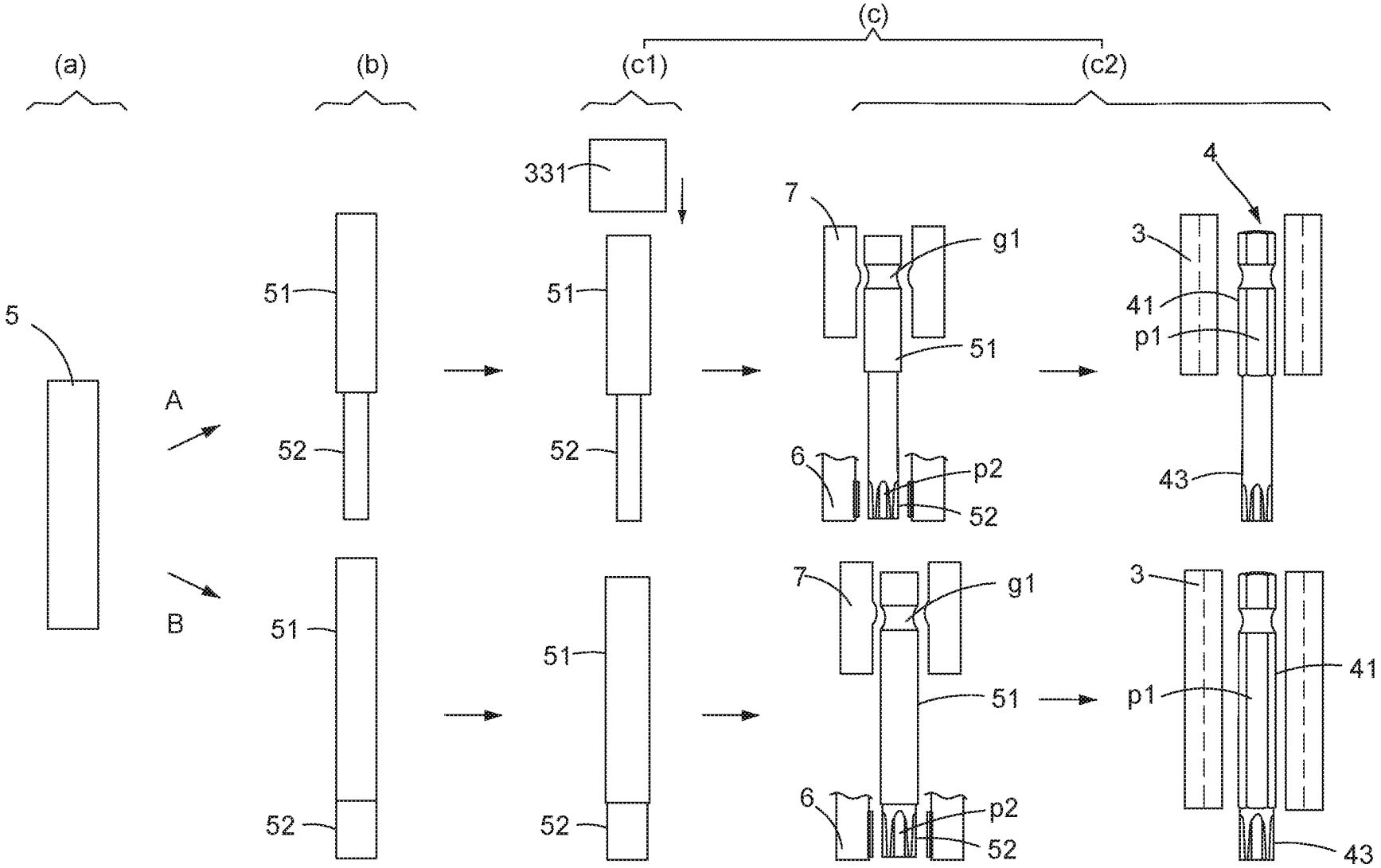
Figures 3, 4, 5:
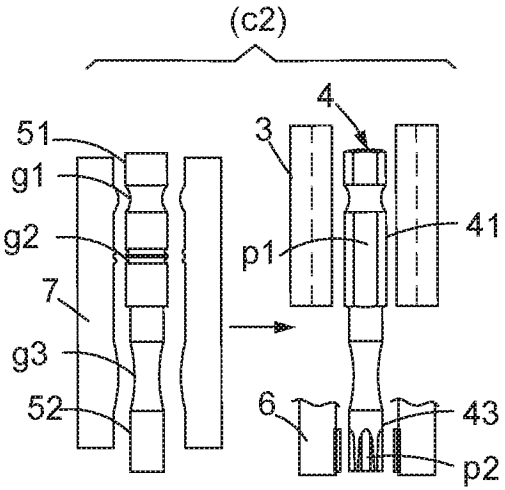

Referring to FIG. 5-1, in the preparation step (a), a cylindrical blank 5 is prepared. The cylindrical blank 5 is a portion cut from a length of a rolled wire rod. In the section-subdividing step (b), the blank 5 is processed to divide the blank 5 into a first section 51 and a second section 52 extending from the first section 51. An outer diameter d1 of the first section 51 is equal to an outer diameter d2 of the second section 52, shown in B type of FIG. 5-1, or is larger than the outer diameter d2 of the second section 52, shown in A type of FIG. 5-1. If the A type is adopted, pressure can be added to the blank 5 partially by pressing or proper means so that the pressed portion reduces its outer diameter, as for example shown in the figure that the outer diameter d2 of the second section 52 becomes smaller. Thus, the first section 51 and the second section 52 are easily distinguishable to facilitate following shaping processes.

The shaping step (c) includes a preparatory shaping operation (c1) and a shape processing operation (c2). The preparatory shaping operation (c1) processes the first section 51 to change its size or contour, particularly to enlarge its outer diameter d1 by suitable ways. For example, one end of the first section 51 is pressed by a stamping die 331, so the length of the first section 51 is reduced and the outer diameter d1 thereof becomes larger, which makes the outer diameter d1 of the first section 51 much larger than the outer diameter d2 of the second section 52. This condition provides a sufficient volume or area to benefit the next shaping operation. The two-tiered arrangement caused by different outer diameters d1, d2 also helps further gripping or feeding actions while shaping.

The shape processing operation (c2) is executed after the operation (c1). In this operation (c2), the first section 51 is shaped into a symmetrical polygon p1, and this section serves as the head portion 41 of the tool 4 after being shaped. The head portion 41 is held by a driving mechanism like a pneumatic mechanism for imparting rotating forces. The second section 52 is also shaped to form a polygon p2 having alternate concavities and convexities thereon, and this section serves as the engaging portion 43 of the tool 4 after being shaped. The engaging portion 43 engages with screw head sockets for adding forces to screw heads.

Figures 5, 6, 7:
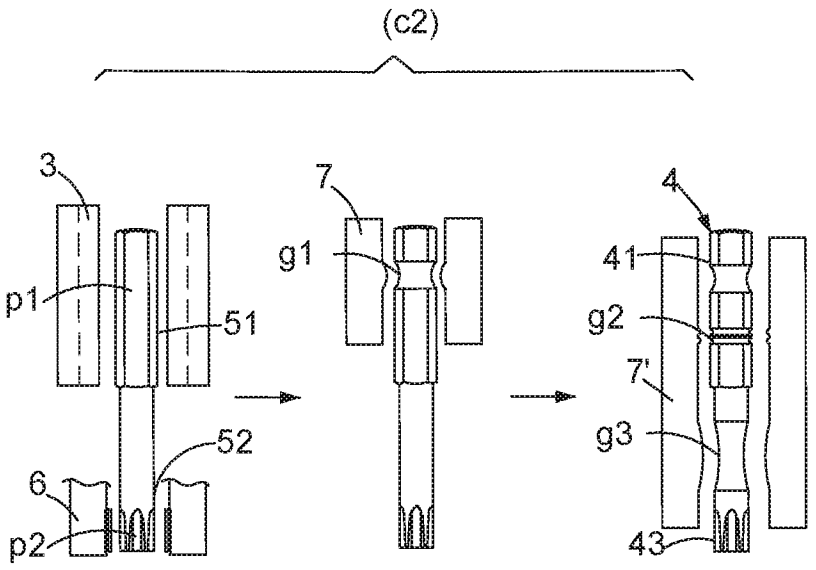
Figures 5, 6:
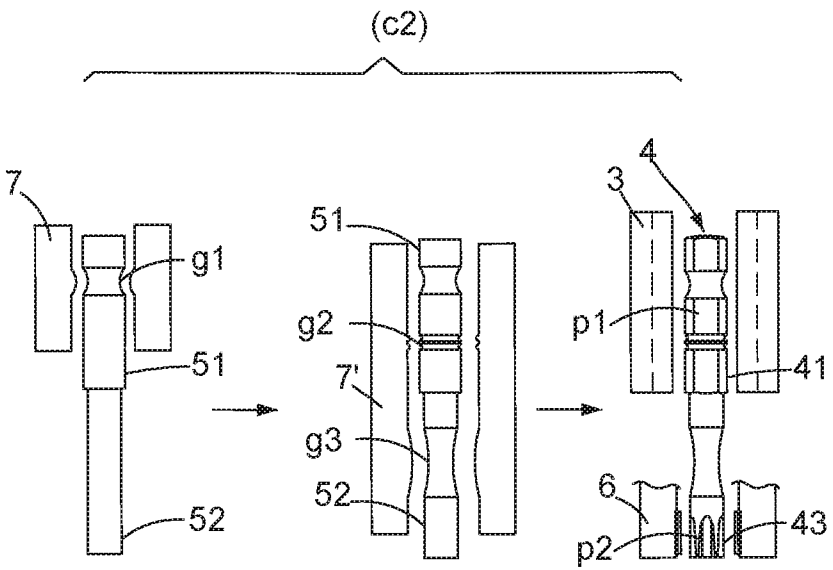
Figure 7:
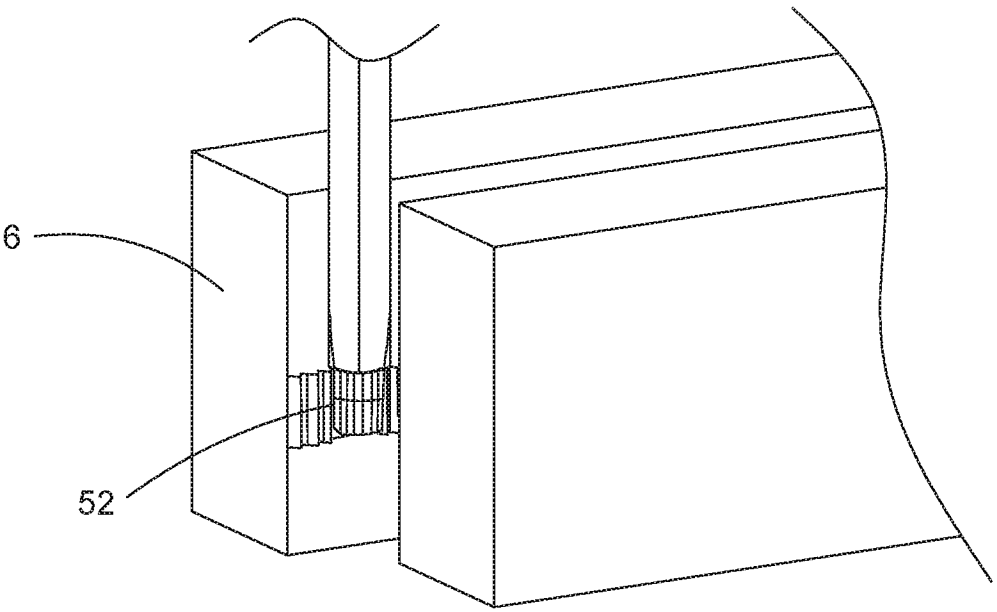
Figure 6:
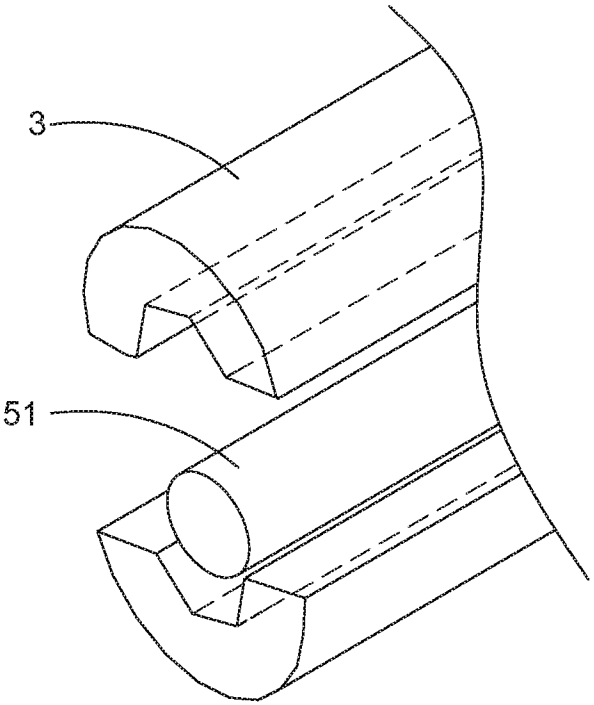

Regarding the process of shaping a symmetrical polygon p1 for the first section 51 in the shape processing operation (c2), pressing dies 3, shown in FIG. 6, are used to shape the first section 51. Preferably, the pressing dies 3 add compressive forces to the first section 51, so the first section 51 is pressed and gradually shaped in a form of a symmetrical polygon p1, namely the polygon with equal sides. It is also possible that the first section 51 is annularly grooved. For example, the first section 51 is annularly pressed by second rolling dies 7 to form a positioning annular groove g1 annularly on a peripheral surface of the first section 51, shown in FIGS. 5-1 and 5-2. The formation of the positioning annular groove g1 can cooperate with the driving mechanism for transmitting forces and can also support gripping or feeding actions to facilitate the shaping process of the second section 52.

Regarding the process of shaping a polygon p2 with alternate concavities and convexities for the second section 52 in the shape processing operation (c2), first rolling dies 6, shown in FIG. 7, are used to shape the second section 52. Preferably, the second section 52 is pressed by rolling between the first rolling dies 6 and then is shaped gradually to form a polygon p2 on which alternate concavities and convexities are formed, namely a polygon having concave recesses and convex ridges each formed between two adjacent concave recesses. Furthermore, this alternating concave and convex arrangement occupies an entire area of the second section 52 so that the polygon p2 follows or is connected to the head portion 41 after being shaped, shown in FIG. 3. Alternatively, the polygon p2 occupies a partial area of the second section 52 so that the polygon p2 is disposed opposite to the head portion 41 after being shaped, shown in FIG. 4. Thus, the tool 4 is made after the two sections 51, 52 are fully shaped to serve as the head portion 41 and the engaging portion 43 respectively.

The above operations are progressively executed to overcome the problem which is that a high carbon steel material cannot be forged, reduce unnecessary consumption of the material caused by the conventional turning method, and save material costs. The shape processing operation (c2) uses the compressing process and the rolling and pressing process, so properties of the blank, made of high carbon content metal material, do not become worse during the execution. Therefore, the tool 4 maintains good mechanical properties. The progressive execution of the method 2 makes or manufactures the tool 4 quickly, increases the manufacturing efficiency, and reduces costs.

Figure 8:
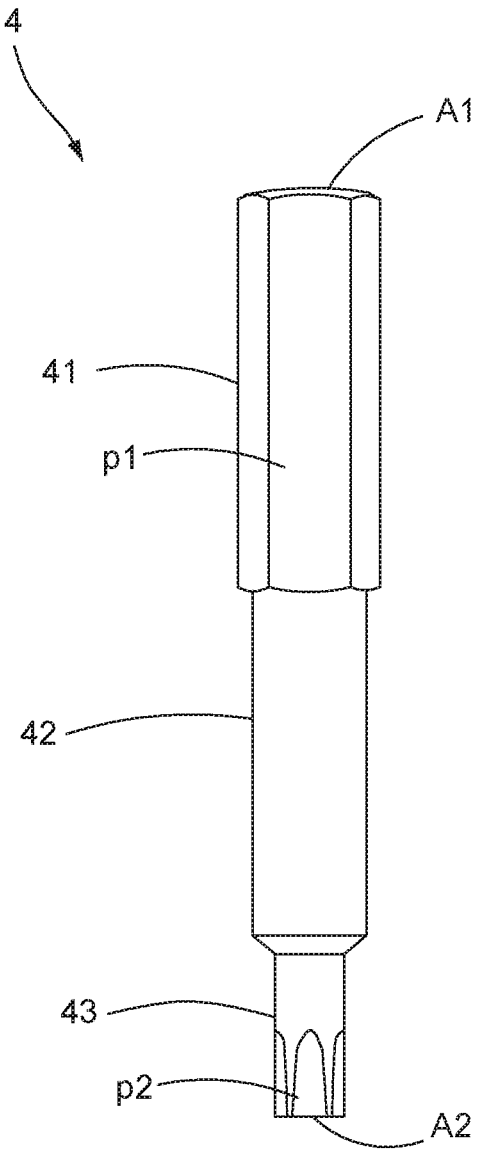
FIG. 8 is a schematic view of a tool to be made of a second preferred embodiment of this invention.
Figure 9:
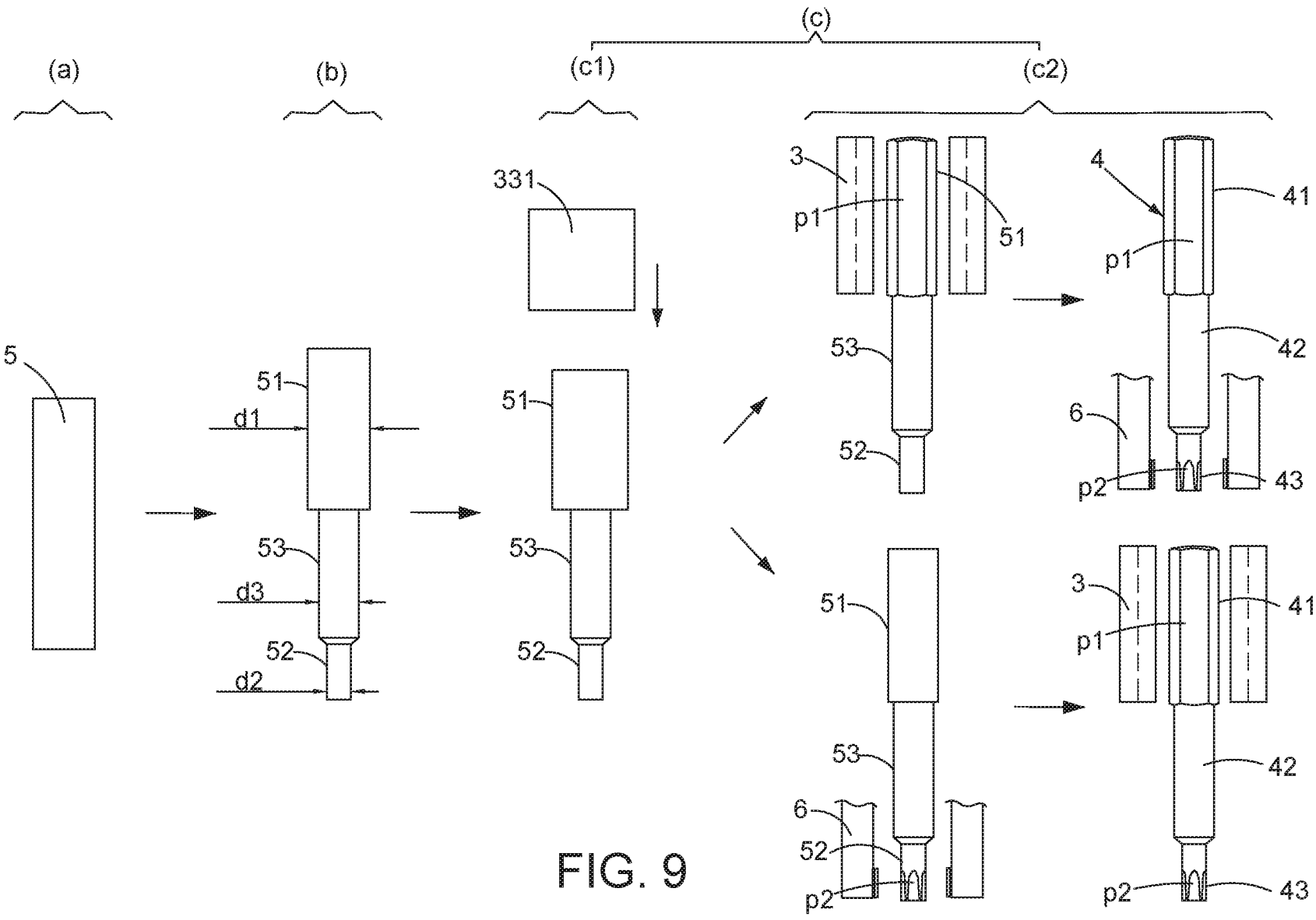
FIG. 9 is a schematic view showing execution steps of the second preferred embodiment of this invention.

Referring to FIG. 9, a second preferred embodiment of a method 2 is executed to make a tool 4 of FIG. 8 having opposite first and second ends A1, A2, at least one shank portion 42, a head portion 41 extending from the first end A1 to the shank portion 42 and being in the shape of a symmetrical polygon p1, and an engaging portion 43 disposed between the head portion 41 and the second end A2. In this preferred embodiment, the engaging portion 43 extends from the shank portion 42 to the second end A2 and having the shape of a polygon p2 provided with alternate concavities and convexities. The portions 41, 42, 43 have different outer diameters. In this preferred embodiment, the method 2 still includes a preparation step (a), a section-subdividing step (b), and a shaping step (c). In the preparation step (a), a cylindrical blank 5, cut from a length of a rolled wire rod, is prepared. In the section-subdividing operation (b), the blank 5 is processed to divide the blank 5 into a first section 51, a second section 52, and at least one third section 53 formed between the two sections 51, 52. The process of dividing the blank 5 into sections can be the same as the process described in the first preferred embodiment and herein is omitted. As for example shown in FIG. 9, a single third section 53 extends from the first section 51 to the second section 52. The three sections 51, 52, 53 have respective outer diameters d1, d2, d3 which are different from each other. Preferably, the outer diameter d3 of the third section 52 is larger than the outer diameter d2 of the second section 52 but is smaller than the outer diameter d1 of the first section 51, thereby forming a three-tiered arrangement to benefit following shaping operations. The blank 5 may be divided into more sections to meet demand.

Figure 10:
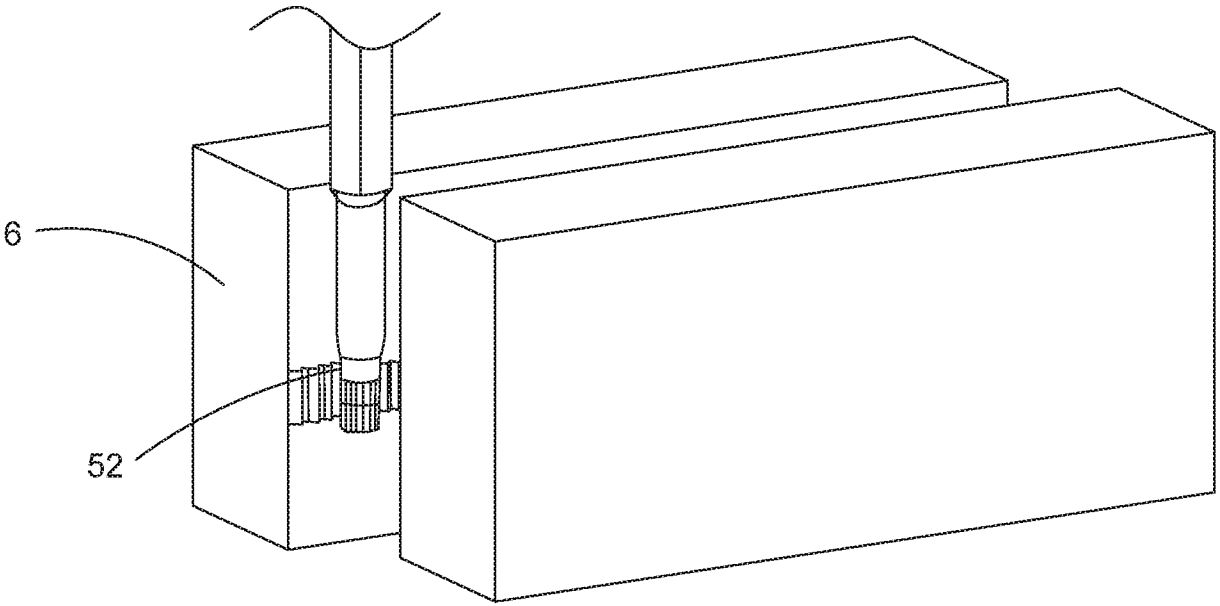
FIG. 10 is a schematic view showing first rolling dies applied to the second preferred embodiment of this invention.

Referring to FIG. 9, in a preparatory shaping operation (c1) of the shaping step (c), the dimension of the first section 51 is changed, that is, the outer diameter d1 of the first section 51 is enlarged to benefit the next shaping operation, as previously described in the first preferred embodiment. Then, the shape processing operation (c2) is executed to shape the enlarged first section 51 and the second section 52. The enlarged first section 51 is shaped to form a symmetrical polygon p1, thereby serving as the head portion 41 of the tool 4. The second section 52 is shaped to form a polygon p2 with alternate concavities and convexities, thereby serving as the engaging portion 43 of the tool 4. The third section 53 serves as the shank portion 42 of the tool 4. It is noted that the shape processing operation (c2) includes using pressing dies 3 shown in FIG. 6 whereby the first section 51 is compressed and then shaped and also includes rolling the second section 52 between first rolling dies 6 shown in FIG. 10 whereby the second section 52 is pressed and then shaped. Accordingly, a tool 4 is obtained after the above shaping processes are done. The execution steps are progressively executed to attain the same effects as the first preferred embodiment, as previously described.

Figure 11:
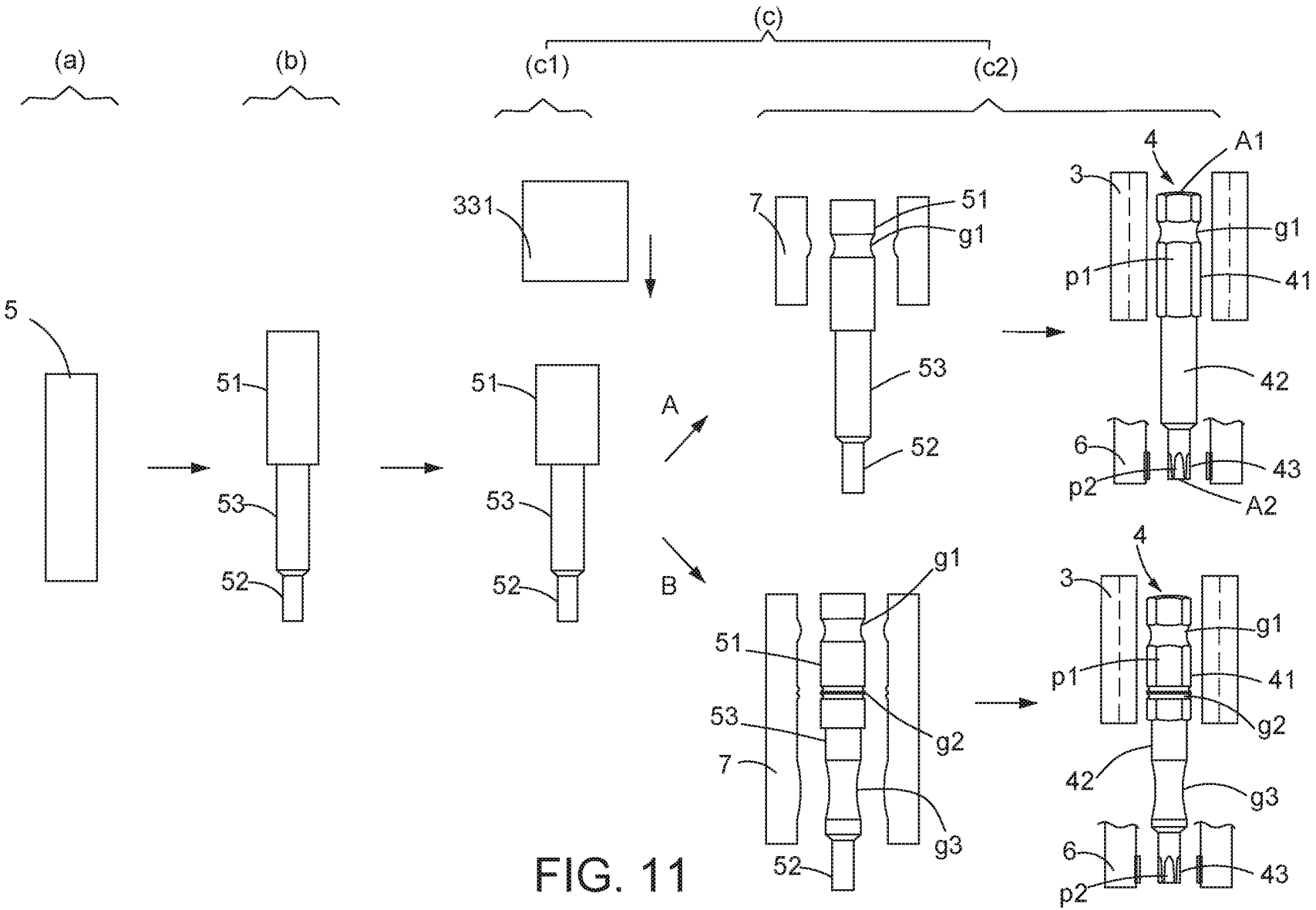
FIG. 11 is a schematic view showing execution steps of a third preferred embodiment of this invention.
Figure 12:
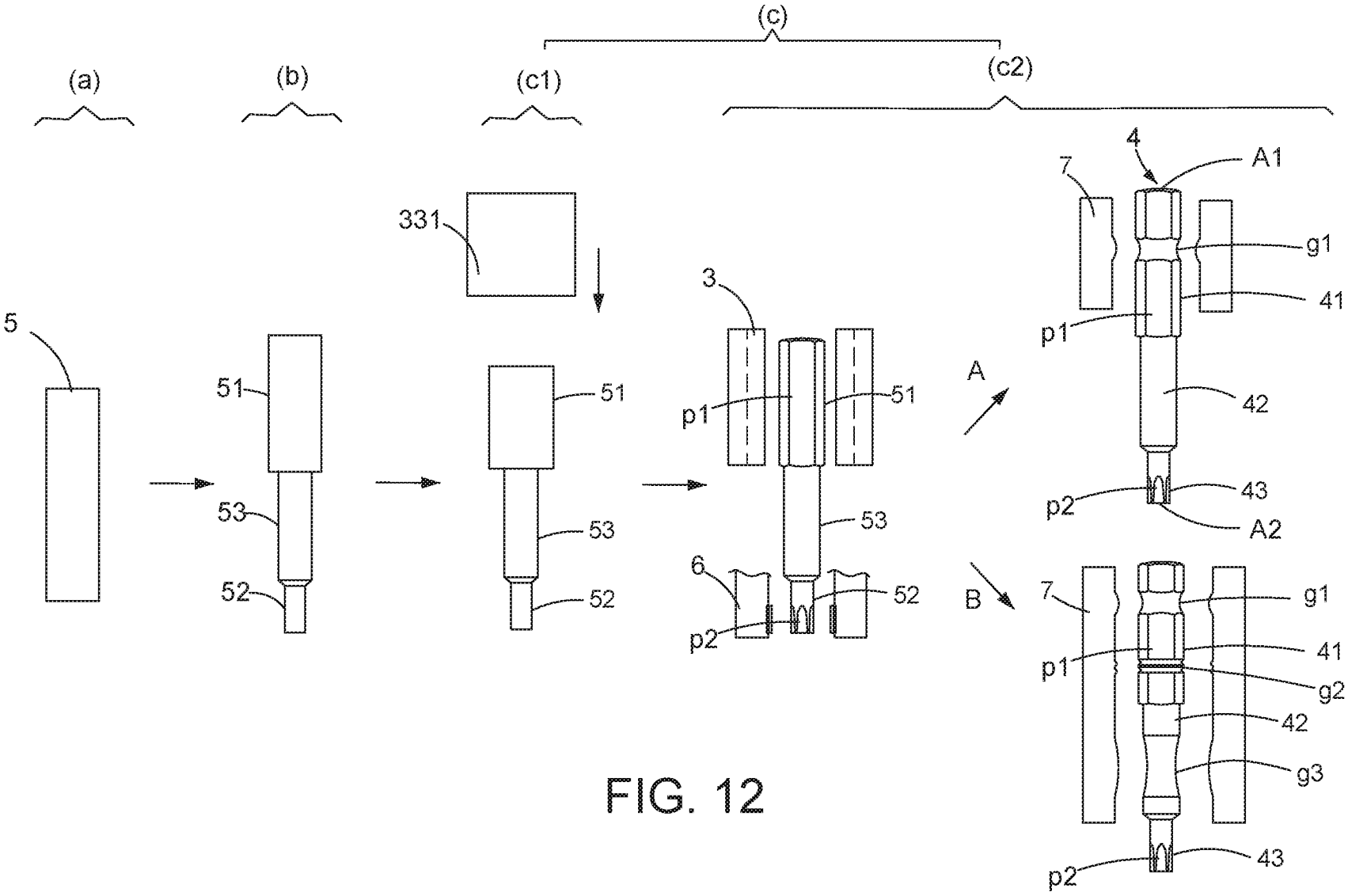
FIG. 12 is a schematic view showing a variation of the third preferred embodiment of this invention.
Figure 13:
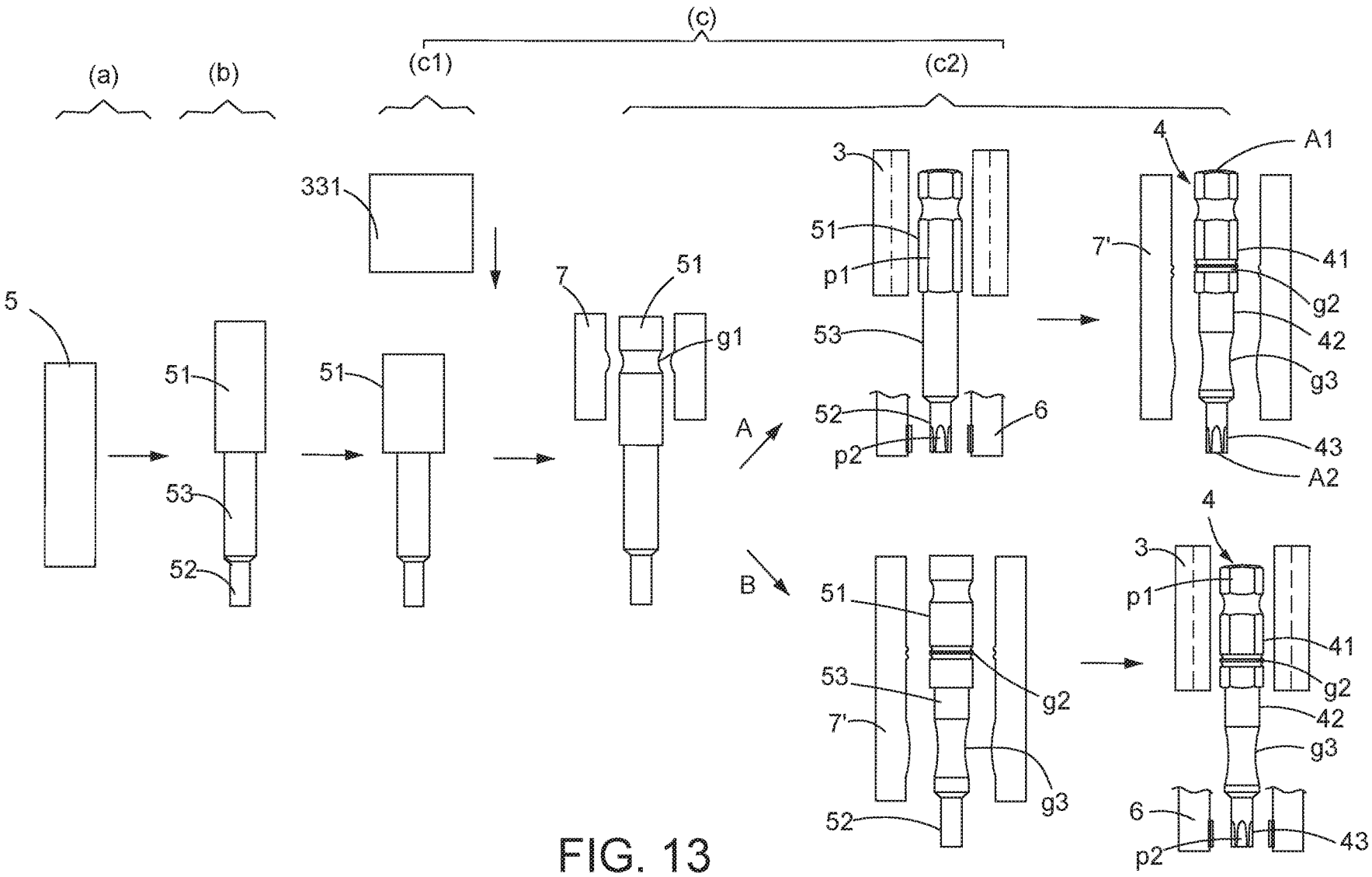
FIG. 13 is a schematic view showing execution steps of a fourth preferred embodiment of this invention.
Figure 14:
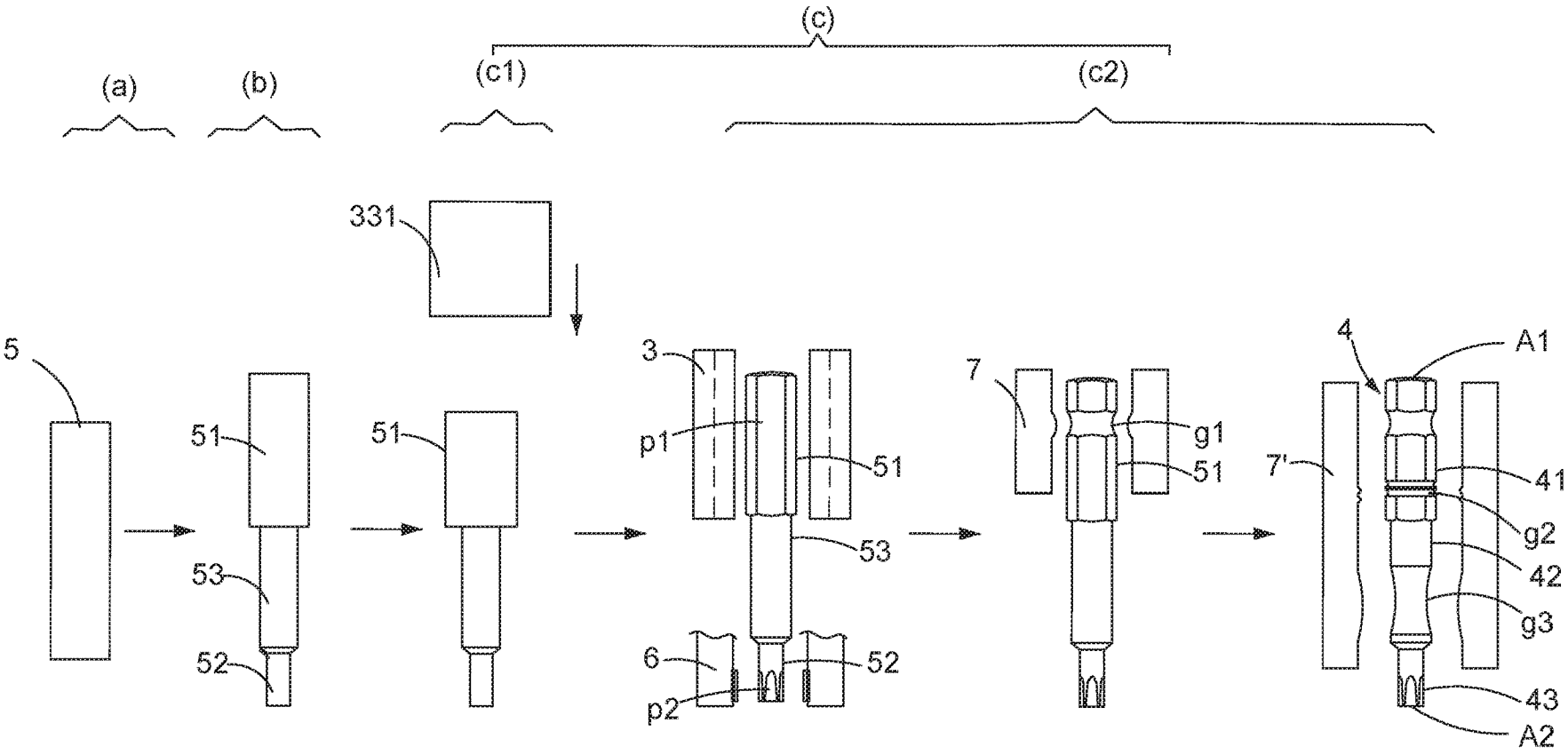
FIG. 14 is a schematic view showing a variation of the fourth preferred embodiment of this invention.

Referring to FIG. 11, a third preferred embodiment of a method 2 still includes a preparation step (a), a section-subdividing step (b), and a shaping step (c) The concatenation of correlated elements and objectives of the steps (a) and (b) are the same as those of the second preferred embodiment and herein are omitted. In the third preferred embodiment, the method 2 is executed to make a tool 4 including at least one shank portion 42, a head portion 41, and an engaging portion 43 that are already described in the second preferred embodiment. Particularly, the head portion 41 and the shank portion 42 can be annularly grooved. For example, the tool 4 has a positioning annular groove g1 formed annularly on the head portion 41 for engaging a driving mechanism, shown in A type of FIGS. 11 and 12. Alternatively, the tool 4 has at least one first auxiliary annular groove g2 and at least one second auxiliary annular groove g3 between the positioning annular groove g1 and the second end A2, shown in B type of FIGS. 11 and 12. Regarding the B type of this preferred embodiment, a preparatory shaping operation (c1) of the shaping step (c) of the method 2 is executed to enlarge the outer diameter of the first section 51 by pressing. Then, the shape processing operation (c2) includes forming a positioning annular groove g1 by pressing the first section 51 annularly and also includes forming at least one auxiliary annular groove annularly between the positioning annular groove g1 and the polygon p2 of the second section 52. For example, a peripheral surface of the first section 51 is annularly pressed to form a first auxiliary annular groove g2 annularly thereon, and a peripheral surface of the third section 53 is annularly pressed to form a second auxiliary annular groove g3 annularly thereon.

The auxiliary annular grooves g2, g3 can also be applied to the two-tiered arrangement of the first preferred embodiment, as illustrated in FIGS. 5-3 to 5-7 showing the variations in the shape processing operation (c2). Furthermore, the auxiliary annular grooves g2, g3 and the positioning annular groove g1 are annularly formed by at least a pair of second rolling dies 7 which operate to press the respective peripheral surfaces of the sections annularly to speed up the manufacturing operation, increase the manufacturing efficiency, and reduce related costs. The term "at least one" is used herein to indicated that the configuration of the second rolling dies is adjustable according to the formation of the grooves. For example, the auxiliary annular grooves g2, g3 and the positioning annular groove g1 are concurrently formed by the same set of second rolling dies 7, shown in FIGS. 5-3 and 5-4 and the B type of FIGS. 11 and 12. Alternatively, they are formed at different time by different sets of second rolling dies 7, 7', shown in FIGS. 5-5 to 5-7, 13, and 14.

In the preferred embodiments of this invention, if the shape processing operation (c2) includes shaping the sections 51, 52 and forming the positioning annular groove g1, the positioning annular groove g1 can be annularly formed before the first section 51 is shaped into the symmetrical polygon p1 (as for example shown in FIGS. 5-2, 5-4 to 5-6, 11, and 13) or can be annularly formed after the first section 51 is shaped into the symmetrical polygon p1 (as for example shown in FIGS. 5-1, 5-3, 5-7, 12, and 14). Considering that the tiered arrangement or the recessed or grooved portion may benefit the gripping or feeding actions during the shaping operation, the execution order of the shaping of the second section 52 can be varied according to either the shaping of the first section 51 or the formation of the positioning annular groove g1, or both of them, as for example shown in figures.

To sum up, the method of this invention includes the steps of preparing a cylindrical blank, dividing the blank into at least two sections, changing the outer diameter of one section, and shaping the sections so that the sections are polygonal in shape to complete a tool. Because the steps are executed in progressive order, the deterioration of properties of the high carbon metal material while processing the blank is prevented to allow the finished tool to have good mechanical properties. The method also promotes the efficiency of manufacturing and decreases manufacturing costs.

While the embodiments of this invention are shown and described, it is understood that further variations and modifications may be made without departing from the scope of this invention.

What is claimed is:

1. A tool manufacturing method for making a tool having opposite first and second ends, a head portion extending from said first end and being in a shape of a symmetrical polygon, and an engaging portion formed between said head portion and said second end and having a form of a polygon with alternate concavities and convexities, said method comprising:

a preparation step which includes preparing a cylindrical blank;

a section-subdividing step which includes processing said blank to thereby axially divide said blank into a first section and a second section; and a shaping step which includes executing a preparatory shaping operation and a shape processing operation, said preparatory shaping operation includes changing an entire outer diameter of said first section by pressing to make said outer diameter of said first section different from an outer diameter of said second section, wherein said preparatory shaping operation includes pressing an end of said first section in an axial direction relative to said blank with a stamping die to enlarge said entire outer diameter of said first section, said shape processing operation being executed after said preparatory shaping operation, said shape processing operation including using pressing dies to add compressive forces to said first section and thereby shape said first section into said symmetrical polygon for serving as said head portion of said tool, and pressing said second section by rolling between a pair of first rolling dies to thereby form said polygon with alternate concavities and convexities thereon, whereby said second section serves as said engaging portion of said tool after being shaped.

2. The method according to claim 1 for making the tool, further comprising at least one shank portion disposed between said head portion and said engaging portion, wherein said section-subdividing step of the method includes forming at least one third section between said first section and said second section, said first section, said second section, and said third section having respective outer diameters which are different from each other, said third section serving as said shank portion of said tool after said shaping step is completed.

3. The method according to claim 2, wherein said shape processing operation includes pressing said first section annularly to form a positioning annular groove on a peripheral surface of said first section.

4. The method according to claim 3, wherein said shape processing operation includes forming at least one auxiliary annular groove annularly between said positioning annular groove and said polygon of said second section, said positioning annular groove and said at least one auxiliary annular groove being annularly formed by at least a pair of second rolling dies.

5. The method according to claim 4, wherein said positioning annular groove and said at least one auxiliary annular groove are concurrently formed.

6. The method according to claim 4, wherein said positioning annular groove and said at least one auxiliary annular groove are not concurrently formed.

7. The method according to claim 2, wherein said outer diameter of said third section is larger than said outer diameter of said second section but is smaller than said outer diameter of said first section.

8. The method according to claim 1, wherein said shape processing operation includes pressing said first section annularly to form a positioning annular groove on a peripheral surface of said first section.

9. The method according to claim 8, wherein said shape processing operation includes forming at least one auxiliary annular groove annularly between said positioning annular groove and said polygon of said second section, said positioning annular groove and said at least one auxiliary annular groove being annularly formed by at least a pair of second rolling dies.

10. The method according to claim 9, wherein said positioning annular groove and said at least one auxiliary annular groove are concurrently formed.

11. The method according to claim 9, wherein said positioning annular groove and said at least one auxiliary annular groove are not concurrently formed.

12. A tool manufacturing method for making a tool having opposite first and second ends, a head portion extending from said first end and being in a shape of a symmetrical polygon, an engaging portion formed between said head portion and said second end and having a form of a polygon with alternate concavities and convexities, and at least one shank portion disposed between said head portion and said engaging portion, said method comprising:

a preparation step which includes preparing a cylindrical blank;

a section-subdividing step which includes processing said blank to thereby divide said blank into a first section and a second section, and forming at least one third section between said first section and said second section, said first section, said second section, and said third section having respective outer diameters which are different from each other; and a shaping step which includes executing a preparatory shaping operation and a shape processing operation, said preparatory shaping operation including changing an outer diameter of said first section by pressing to make said outer diameter of said first section different from an outer diameter of said second section, said shape processing operation being executed after said preparatory shaping operation, said shape processing operation including shaping said first section into said symmetrical polygon for serving as said head portion of said tool and shaping said second section to form said polygon with alternate concavities and convexities thereon, whereby said second section serves as said engaging portion of said tool after being shaped, and said third section serves as said shank portion of said tool after said shaping step is completed.

13. A tool manufacturing method for making a tool having opposite first and second ends, a head portion extending from said first end and being in a shape of a symmetrical polygon, and an engaging portion formed between said head portion and said second end and having a form of a polygon with alternate concavities and convexities, said method comprising:

a preparation step which includes preparing a cylindrical blank;

a section-subdividing step which includes processing said blank to thereby divide said blank into a first section and a second section; and a shaping step which includes executing a preparatory shaping operation and a shape processing operation, said preparatory shaping operation including changing an outer diameter of said first section by pressing to make said outer diameter of said first section different from an outer diameter of said second section, said shape processing operation being executed after said preparatory shaping operation, said shape processing operation including shaping said first section into said symmetrical polygon for serving as said head portion of said tool and shaping said second section to form said polygon with alternate concavities and convexities thereon, whereby said second section serves as said engaging portion of said tool after being shaped, said shape processing operation further including pressing said first section annularly to form a positioning annular groove on a peripheral surface of said first section, and forming at least one auxiliary annular groove annularly between said positioning annular groove and said polygon of said second section, said positioning annular groove and said at least one auxiliary annular groove being annularly formed by rolling between at least a pair of rolling dies.

* * * * *